US008359760B2

(12) United States Patent
Foser

(10) Patent No.: US 8,359,760 B2
(45) Date of Patent: Jan. 29, 2013

(54) FORM ALIGNER FOR CONCRETE FORMWORK

(75) Inventor: Thomas Foser, Balzers (LI)

(73) Assignee: Hilti Aktiengesellschaft, Schaan (LI)

( * ) Notice: Subject to any disclaimer, the term of this patent is extended or adjusted under 35 U.S.C. 154(b) by 372 days.

(21) Appl. No.: 12/592,660

(22) Filed: Dec. 1, 2009

(65) Prior Publication Data

US 2010/0140449 A1 Jun. 10, 2010

(30) Foreign Application Priority Data

Dec. 9, 2008 (DE) ..... 10 2008 054 402

(51) Int. Cl.
*G01B 3/00* (2006.01)

(52) U.S. Cl. ..... 33/518; 33/527

(58) Field of Classification Search ..... 33/518, 33/526, 561.1, DIG. 20, 404–407
See application file for complete search history.

(56) References Cited

U.S. PATENT DOCUMENTS

| | | | | |
|---|---|---|---|---|
| 2,930,135 | A * | 3/1960 | Rodtz, Sr. | 33/518 |
| 3,010,213 | A * | 11/1961 | Rodtz, Sr. | 33/526 |
| 3,735,497 | A * | 5/1973 | Boettcher | 33/526 |
| 5,136,785 | A * | 8/1992 | Shirley | 33/404 |
| 5,288,534 | A * | 2/1994 | Tavshanjian | 33/526 |
| 5,479,745 | A * | 1/1996 | Kawai et al. | 52/126.6 |
| 6,347,459 | B1 * | 2/2002 | Schmitt | 33/561.2 |
| 6,625,951 | B1 * | 9/2003 | McCarthy | 33/527 |
| 6,874,242 | B2 * | 4/2005 | Shilo et al. | 33/526 |
| 7,516,558 | B2 * | 4/2009 | Frank et al. | 33/526 |
| 7,673,393 | B1 * | 3/2010 | Hudson | 33/409 |
| 7,946,093 | B1 * | 5/2011 | Sturino | 33/527 |
| 2004/0060184 | A1 * | 4/2004 | Shilo et al. | 33/526 |
| 2009/0235548 | A1 * | 9/2009 | Higgs et al. | 33/518 |
| 2009/0256053 | A1 * | 10/2009 | Foser et al. | 249/1 |
| 2010/0140449 | A1 * | 6/2010 | Foser | 249/188 |

FOREIGN PATENT DOCUMENTS

| | | | |
|---|---|---|---|
| EP | 0 971 084 | A1 | 1/2000 |
| EP | 2196599 | A2 * | 6/2010 |

* cited by examiner

*Primary Examiner* — Yaritza Guadalupe-McCall
(74) *Attorney, Agent, or Firm* — Davidson, Davidson & Kappel, LLC

(57) ABSTRACT

The present invention relates to a form aligner for concrete formwork, having a fastening part that extends along an axis (A), with a base for purposes of placement onto a structural component and having an opening with an abutment for a fastening element as well as at least one form alignment contact point for a formwork wall. With such a form aligner, several elongated form alignment contact points running coaxially to the axis (A) are provided, of which at least two form alignment contact points constitute form alignment pairs that are in a shared plane.

16 Claims, 1 Drawing Sheet

FORM ALIGNER FOR CONCRETE FORMWORK

This claims the benefit of German Patent Application No. 10 2008 054 402.7, filed Dec. 9, 2009 and hereby incorporated by reference herein.

The present invention relates to a form aligner for concrete formwork.

BACKGROUND

European patent application EP 0 971 084 A1 discloses a form aligner for concrete formwork, comprising a base body having a circular-cylindrical outer wall, whereby the base body has a base for purposes of placement onto a structural component. The outer wall constitutes a form alignment surface for concrete formwork. A sleeve which has an opening for a fastening element and which defines a fastening axis of the form aligner is arranged in the center of the intermediate base.

A disadvantage of such form aligners is that they can remain visible when they are used for column formwork since the round form aligners fill up the corners between two formwork walls, as a result of which there is little free space into which the concrete could flow.

SUMMARY OF THE INVENTION

It is an object of the present invention to provide a form aligner that leaves a circulation path free for inflowing concrete when used in the corners between two formwork walls.

The present invention provides a form aligner for concrete formwork, having a fastening part that extends along an axis (A), with a base for purposes of placement onto a structural component and having an opening with an abutment for a fastening element as well as at least one form alignment contact point for a formwork wall. Several elongated form alignment contact points running coaxially to the axis (or fastening axis) are provided, of which at least two constitute form alignment pairs that are in a shared plane. This results in an axial free space between the form alignment contact points. This configuration according to the invention ensures that the form aligner leaves a path free so that concrete can flow all around the form aligner, as a result of which the form aligners remain visually inconspicuous in the finished concrete column, and thus do not detract from the appearance. However, at the same time, good functionality is achieved in terms of the sturdiness of the form aligner relative to the formwork walls.

Advantageously, in each case, two elongated form alignment contact points constitute a form alignment pair that is arranged on a form alignment arm extending from the center, as a result of which the stability and sturdiness of the trough-shaped form aligners is enhanced.

It is likewise advantageous for the elongated form alignment contact points that are configured in pairs to be arranged on trough-shaped form alignment elements that are installed at ends of the form alignment arms facing away from the center. This configuration accounts for a high degree of stability of the form alignment contact points, along with a certain amount of elasticity that counters an undesired breakage of the form alignment contact points when a formwork aligner is aligned. At the same time, the trough-shaped form alignment elements that run approximately parallel to the axis or to the fastening axis leave a space free for the flowing concrete.

An advantageously optimized geometry results from providing two form alignment arms that enclose an angle between 110° and 130°. This allows two formwork walls that are approximately at a right angle to each other to be optimally supported.

It is likewise favorable for the elongated form alignment contact points to lie on an enveloping circle that has a radius with respect to the axis. As a result, two adjacent form alignment contact points of the two form alignment arms are also on a shared plane and can thus be utilized to support a formwork wall.

Very stable support can also be achieved if a support arm extending from the center is provided which, together with at least one form alignment arm, encloses an angle (β) between 110° and 130°.

Advantageously, the fastening part is arranged on the support arm, and a fastening element can be arranged on said fastening part in order to attach the form aligner to a structural component.

It is likewise advantageous for at least one support element to protrude from the support arm, as a result of which the forces can be more efficiently transferred and consequently greater loads can be accommodated.

The drawings depict several embodiments of the invention.

BRIEF DESCRIPTION OF THE DRAWINGS

The following is shown.

DETAILED DESCRIPTION

Figure 1:
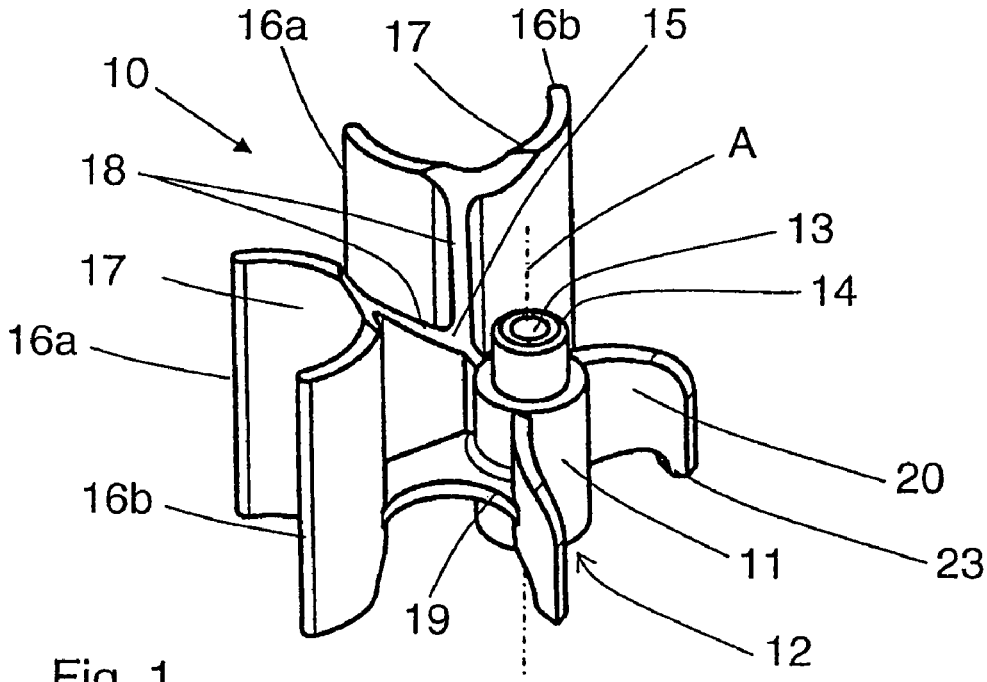
FIG. 1—a perspective view of a form aligner according to the invention.
Figure 2:
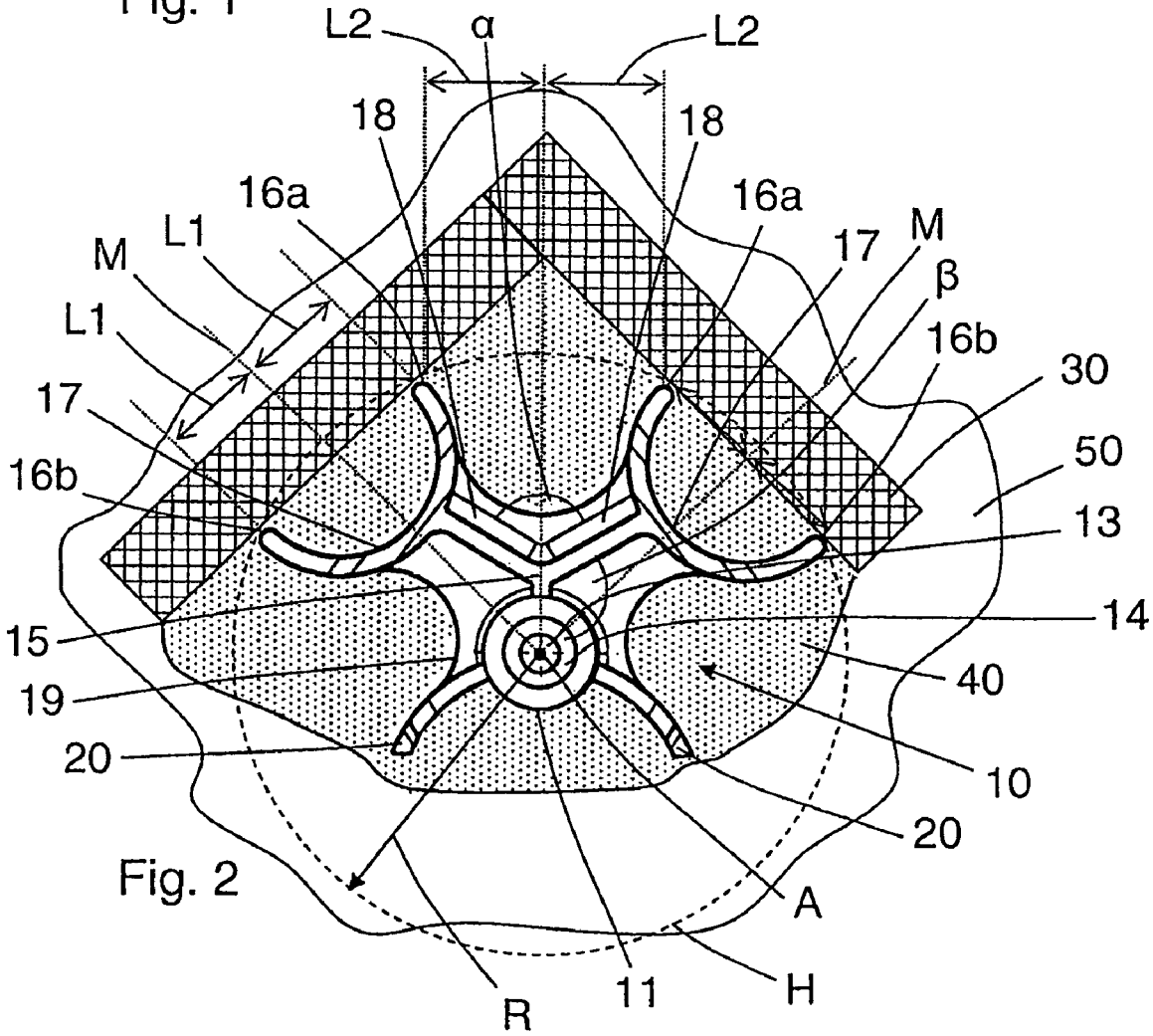
FIG. 2—a cross section of the form aligner from FIG. 1 along marking II-II, whereby two formwork walls and the poured concrete are indicated with broken lines and shading.

FIGS. 1 and 2 show a form aligner 10 according to the invention configured as a formwork aligner. The form aligner 10 has a base 12 for purposes of placement onto a structural component such as, for example, a baseplate, a concrete floor or ceiling and the like. For this purpose, the base 12 has at least one placement surface. The form aligner 10 has, for instance, a sleeve-shaped fastening part 11 that defines an axis A and that has an opening 13 for a fastening element. Around this opening 13, an abutment 14 is configured for the fastening element.

Moreover, the form aligner 10 has three arms branching off from the center 15. Of these arms, two are configured as form alignment arms 18 and one as a support arm 19. The ends of the form alignment arms 18 facing away from the center 15 make a transition to trough-shaped form alignment elements 17 whose outer edges running in the axial direction each constitute first form alignment contact points **16*a* and second form alignment contact points 16*b*. In this context, the form alignment arms 18 are at an angle α of 120° relative to each other, whereby angles α within the range from 110° to 130° are also possible. Axially positioned free spaces exist between the elongated form alignment contact points 16*a*, 16*b* and they leave a space free for the flowing concrete. In contrast, the fastening part 11, along with the opening 13 and the abutment 14, is arranged on the support arm 19. Furthermore, two more support elements 20 that have feet 23 that allow them to be placed on a structural component 50 are provided on the free end of the support arm 19. The support elements 20 are curved like a quarter circle parallel to their extension in the direction of the axis A. The support arm 19 is at an angle β of 120° relative to the adjacent form alignment arm 18**, whereby angles β within the range from 110° to 130° are also possible.

The form alignment contact points 16*a*, 16*b* running in the axial direction and configured as form alignment edges are all on a shared enveloping circle H whose center point lies in the axis A, with respect to which it has a radius R. Accordingly, the radius R also corresponds to the radial distance of the form alignment contact points 16*a*, 16*b* with respect to the axis A. The positioning of all form alignment contact points 16*a*, 16*b* of the form alignment arms 18 on a shared enveloping circle H yields three form alignment areas, namely, the two form alignment areas formed by the form alignment contact points 16*a*, 16*b* of one form alignment arm 18, and the form alignment area that is formed by the adjacent form alignment contact points 16*a*, 16*b* of the two form alignment arms 18.

Moreover, the geometry of the form alignment contact points 16*a*, 16*b* relative to the axis A is selected in such a way that the effective lever L1 of the form alignment contact points 16*a*, 16*b* with respect to a line running perpendicular to the axis is the same length as the effective lever L2 of the form alignment contact points 16*a* of the two form alignment arms 18 that are adjacent to each other. Since L1=L1 and L2=L2 and L1=L2, the forces acting during the formwork installation procedure are uniformly distributed onto the fastening part 11 or onto the fastening point. Moreover, this causes the form aligner 10 to be automatically aligned during the formwork installation procedure.

The median lines M of the trough-shaped form alignment elements 17, which run perpendicular to the axis A, are preferably at a right angle relative to each other.

In FIG. 2, the form aligner 10 is attached to a structural component 50 such as, for instance, a concrete floor or ceiling, whereby the fastening element was not shown for the sake of simplicity. Two formwork walls 30 that are at a right angle relative to each other and that are each supported on the form alignment contact points 16*a*, 16*b* of a form alignment arm 18 lie against the form aligner 10. The formwork has already been poured with concrete 40 that virtually surrounds the form aligner 10. Once the formwork is removed, all that remains visible are the form alignment edges or form alignment contact points 16*a*, 16*b*.

What is claimed is:

1. A form aligner for concrete formwork comprising:

a fastening part extending along an axis, with a base for purposes of placement onto a structural component and having an opening with an abutment for a fastening element, and several elongated form alignment contact points for a formwork wall running coaxially to the axis, at least two of the form alignment contact points constituting form alignment pairs in a shared plane; wherein, in each case, two elongated form alignment contact points constitute a form alignment pair arranged on a form alignment arm extending from a center.

2. The form aligner as recited in claim 1 wherein the elongated form alignment contact points configured in pairs are arranged on trough-shaped form alignment elements installed at ends of the form alignment arms facing away from the center.

3. The form aligner as recited in claim 1 wherein the elongated form alignment contact points lie on an enveloping circle having a radius with respect to the axis.

4. The form aligner as recited in claim 1 further comprising a support arm with at least one support element protruding from the support arm.

5. A form aligner for concrete formwork comprising:

a fastening part extending along an axis, with a base for purposes of placement onto a structural component and having an opening with an abutment for a fastening element, and several elongated form alignment contact points for a formwork wall running coaxially to the axis, at least two of the form alignment contact points constituting form alignment pairs in a shared plane; wherein two form alignment arms are provided that enclose an angle (α) between 110° and 130°.

6. A form aligner for concrete formwork comprising:

a fastening part extending along an axis, with a base for purposes of placement onto a structural component and having an opening with an abutment for a fastening element, and several elongated form alignment contact points for a formwork wall running coaxially to the axis, at least two of the form alignment contact points constituting form alignment pairs in a shared plane; wherein the elongated form alignment contact points lie on an enveloping circle having a radius with respect to the axis.

7. The form aligner as recited in claim 6 wherein two form alignment arms are provided that enclose an angle (α) between 110° and 130°.

8. The form aligner as recited in claim 6 further comprising a support arm with at least one support element protruding from the support arm.

9. A form aligner for concrete formwork comprising:

a fastening part extending along an axis, with a base for purposes of placement onto a structural component and having an opening with an abutment for a fastening element, and several elongated form alignment contact points for a formwork wall running coaxially to the axis, at least two of the form alignment contact points constituting form alignment pairs in a shared plane; and a support arm extending from a center, the support arm, together with at least one form alignment arm, enclosing an angle between 110° and 130°.

10. The form aligner as recited in claim 9 wherein the fastening part is arranged on the support arm.

11. The form aligner as recited in claim 9 further comprising at least one support element protruding from the support arm.

12. The form aligner as recited in claim 9 wherein the at least one form alignment arm includes two form alignment arms.

13. The form aligner as recited in claim 9 wherein two form alignment arms of the at least one form alignment arm are provided that enclose an angle (α) between 110° and 130°.

14. The form aligner as recited in claim 9 wherein the elongated form alignment contact points lie on an enveloping circle having a radius with respect to the axis.

15. A form aligner for concrete formwork comprising:

a fastening part extending along an axis, with a base for purposes of placement onto a structural component and having an opening with an abutment for a fastening element, and several elongated form alignment contact points for a formwork wall running coaxially to the axis, at least two of the form alignment contact points constituting form alignment pairs in a shared plane, and a support arm with at least one support element protruding from the support arm.

16. The form aligner as recited in claim 15 wherein the support arm, together with at least one form alignment arm encloses an angle between 110° and 130°.

* * * * *